United States Patent [19]

Skatsche et al.

[11] 4,370,957

[45] Feb. 1, 1983

[54] ASSEMBLY OF AUXILIARY EQUIPMENT FOR A WATER-COOLED INTERNAL COMBUSTION ENGINE

[75] Inventors: Othmar Skatsche; Johann Wagner; Bertram Obermayer, all of Graz, Austria

[73] Assignee: Hans List, Graz, Austria

[21] Appl. No.: 228,219

[22] Filed: Jan. 26, 1981

[30] Foreign Application Priority Data

Jan. 24, 1980 [AT] Austria ..... 392/80

[51] Int. Cl.[3] ..... F01M 1/00

[52] U.S. Cl. ..... 123/196 AB; 123/41.33; 123/196 R

[58] Field of Search ..... 123/41.33, 41.44, 41.47, 123/41.55, 196 AB, 196 R, 196 A, 198 C; 417/201; 210/186

[56] References Cited

U.S. PATENT DOCUMENTS

| | | | |
|---|---|---|---|
| 1,235,898 | 8/1917 | Jay | 123/196 A |
| 1,291,839 | 1/1919 | Gorham | 123/41.33 |
| 3,353,590 | 11/1967 | Holman | 123/41.33 |

*Primary Examiner*—Charles J. Myhre
*Assistant Examiner*—E. Rollins Cross
*Attorney, Agent, or Firm*—Watson, Cole, Grindle & Watson

[57] ABSTRACT

An assembly of auxiliary equipment for a water-cooled internal combustion engine having an oil pump, a water pump and an oil cooler/oil filter unit, wherein the oil pump, water pump and oil cooler/oil filter unit are provided as separate interchangeable subassemblies and are combined and interconnected into a constructional unit that can be mounted on the engine.

2 Claims, 3 Drawing Figures

ASSEMBLY OF AUXILIARY EQUIPMENT FOR A WATER-COOLED INTERNAL COMBUSTION ENGINE

BACKGROUND OF THE INVENTION

This invention relates to an assembly of auxiliary equipment for a water-cooled internal combustion engine, having an oil pump, a water pump, an oil cooler, and an oil filter.

In water-cooled internal combustion engines of known construction, the oil pump, water pump, and an oil cooler/oil filter unit are placed at various locations in the engine, thereby necessitating complex and expensive connecting lines for oil and water which, depending on the locations of the individual pumps and the oil cooler/oil filter unit, are designed as bores in the crank housing or as external lines.

While it is common practice in diesel engines to mount the fuel-injection pump on an aluminum casting which also carries the oil pump, a filter, a safety valve, a fuel pump, and a vacuum pump, this does not eliminate the problem referenced above.

SUMMARY OF THE INVENTION

One subject of the present invention is to design the assembly of auxiliary equipment such as to eliminate the aforementioned problem with minimum outlays of material and energy and at the same time to provide for a simplified corrective maintenance for all the auxiliary equipment mentioned above.

According to the invention, this object is achieved by designing the oil pump, water pump, and oil cooler/oil filter unit as separate interchangable subassemblies and combining them into one contructional unit which can be mounted on the internal combustion engine.

Prior to attachment to the internal combustion engine, this constructional unit comprising all the auxiliary equipment mentioned above is assembled and affixed to the internal combustion engine, with the result that at the same time all the connecting lines for oil and water are fabricated. In this type, all repairs or replacement of the assembled components can be effected very rapidly. Moreover, the entire assembly can be easily replaced. And, a special supporting member can be dispensed with in an assembly which embodies the principles of the invention.

According to the invention, it is also possible to provide the housing of the oil cooler/oil filter unit with a mounting surface for attachment to the internal combustion engine and with a flange on the side to which the water pump can be fastened with its flange, and to provide the water pump, in turn, with a flange for attachment of the oil pump with its flange, the oil and water connecting lines being passed through the fastening flanges. Thus, an assembly is formed for which the oil-cooler housing serves at the same time as the supporting member for the oil pump and the water pump, but in an assembly affixed to the internal combustion engine either the oil pump alone or the water pump and the oil pump together can be disassembled.

According to another feature of the invention, a very simple construction is achieved by providing the oil pump and the water pump with a common drive. Advantageously, the driven gear of the oil pump and the impeller of the water pump are seated on a common drive shaft carried in the housings of the oil pump and of the water pump. A practical embodiment of the invention consists in providing in the housing all the ducts for the supply and discharge of the oil and the water.

BRIEF DESCRIPTION OF THE DRAWING

The invention will now be described with reference to the practical embodiment shown in the drawing, wherein.

Figure 1:
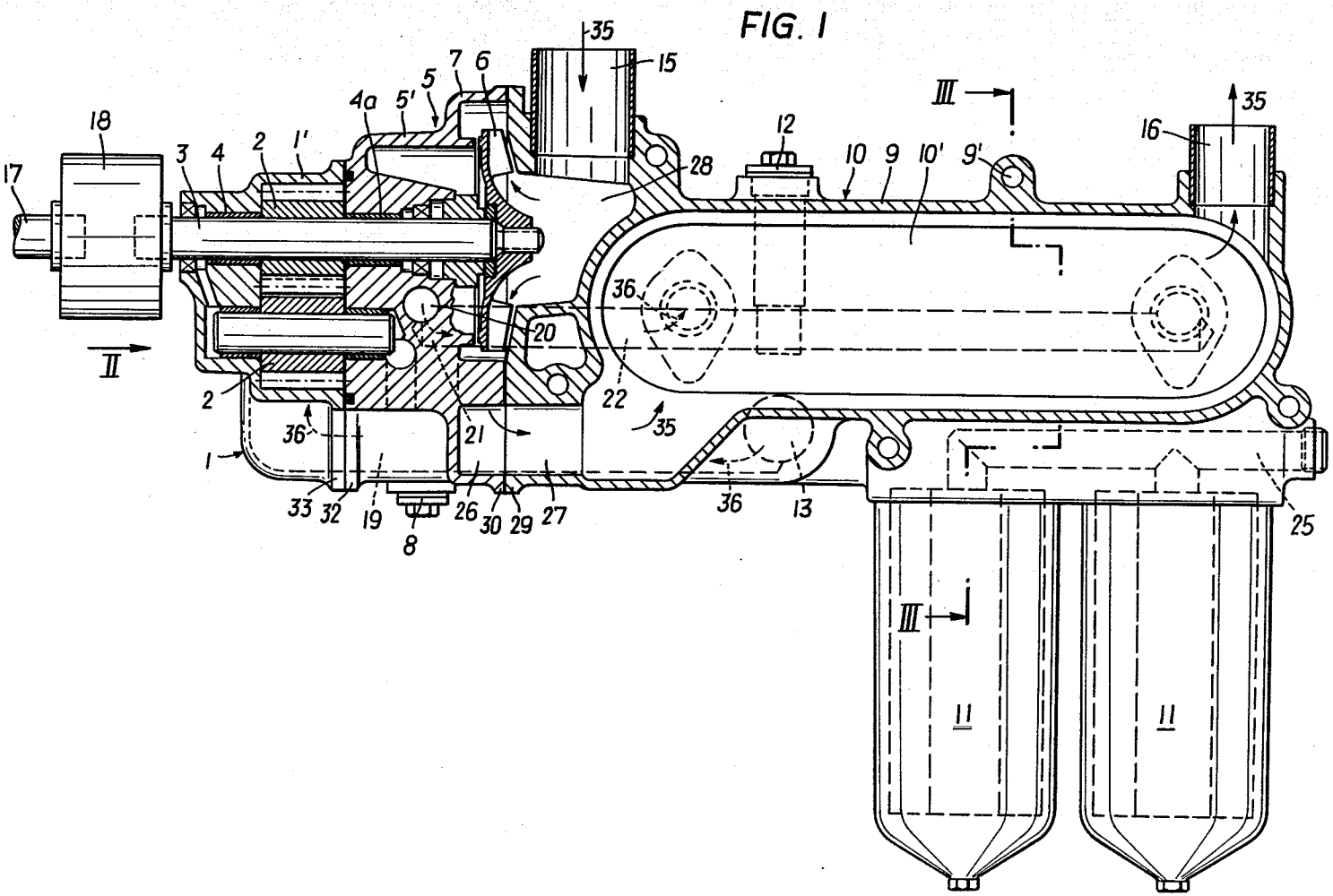
FIG. 1 is a view, partially in section, of the assembly for auxiliary equipment embodying the principles of the invention.

In the assembly for auxiliary equipment the individual subassemblies: oil pump 1, water pump 5, and oil cooler/oil filter unit 10 are combined into one constructional unit, in accordance with the principles of the invention. Oil pump 1 comprises a housing 1', which encloses the two oil-pump gears 2 and the drive shaft 3, as well as their bearing 4.

Water pump 5 comprises the water-pump housing 5', in which is mounted an impeller 6 of the water pump, the impeller being mounted on drive shaft 3. The water-pump housing forms a helical interior 7 in which enters impeller 6 of the water pump and which in this way constitutes the pressure chamber of the water pump. In water-pump housing 5' are located the second bearings 4a for drive shaft 3 and for oil-pump gears 2. The safety valve of the oil pump is denoted by reference numeral 8.

The housing for oil cooler 10' and oil filter 11' is denoted by reference numeral 9. This housing 9 can be mounted on the internal combustion engine by means of screws which pass through the housing in throughholes 9'. There are further provided in the housing a bypass valve 12 of oil cooler 10', oil passages 13 and 14', as well as a water inlet 15 and a water outlet 16, and a suction chamber 28 for water pump 5.

Figure 2:
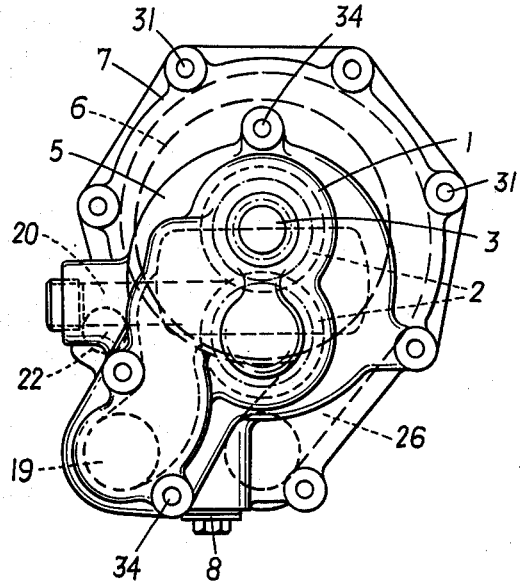
FIG. 2 is a view in the direction towards the drive end.

In housing 9 for oil cooler 10' an oil filter 11 a flange 29 is provided, to which water pump 5 can be fastened with its flange 30. The fastening screws, which are screwed into the flange and are not shown herein, pass through flange 30 in throughholes 31 (FIG.2). To fasten oil-pump housing 1 to water-pump housing 5', corresponding flanges 32 and 33 are provided on oil-pump housing 1' and on water-pump housing 5', respectively. The corresponding throughholes 34 for the fastening screws are shown in FIG. 2. As apparent from this Figure, oil pump 1 can be detached from water pump 5, and the latter, in turn, can be detached from oil-filter housing 9 independently from one another. This is possible even if housing 9 for oil cooler 10' and oil filter 11 is mounted with its mounting surface 14 onto the internal combustion engine. This is a significant advantage for the maintenance of the accessory equipment.

Drive shaft 3 for oil pump gears 2 is driven by means of a gear drive not shown and by an input shaft extension 17 and a coupling 18. The oil is sucked up from the oil pan via lines or boxes into the crankcase of the internal combustion engine and via oil inlet 13 and oil duct 19 into interconnected housings 9, 5' and 1'. By means of oil pump 1 the oil flows via duct 20 in the water pump housing 5' into duct 25. Bore 22 in housing 9 is divided into two ducts by bypass valve 12. The duct shown on the left side of the drawing serves for the entry of the oil into oil cooler 10' and the right duct for the passage of the oil after oil cooler 10' via ducts 23

Figure 3:
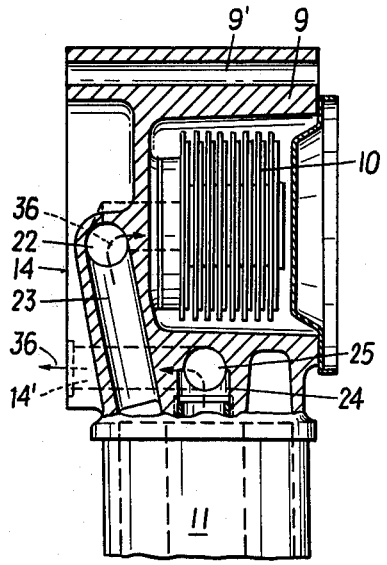
FIG. 3 is a cross-sectional view taken along the line III—III of FIG. 1.

(FIG. 3) to oil filters 11. After leaving oil filters 11 the oil flows via ducts 24 and 25 to oil passage 14' in housing 9 and from there to the crankcase housing not shown and further into the main oil duct thereof.

The cooling water enters suction chamber 28 in housing 9 via intake tube 15, then flows via impeller 6 of the water pump into the helical chamber 7 in water-pump housing 5', into duct 26 and, via the corresponding duct 27 in housing 9, into the chamber of housing 9 surrounding oil cooler 10'. From the oil-cooler chamber the water exits via tube 16 and flows via a duct not shown into the water chamber of the cylinder block. The flow paths of the water are indicated by full-line arrows 35 and the flow paths of the oil by broken-line arrows 36.

Obviously, many modifications and variations of the invention are made possible in the light of the above teachings. It is therefore to be understood that within the scope of the appended claims the invention may be practiced otherwise than as specifically described.

What is claimed is:

1. An assembly of auxiliary equipment for a water-cooled internal combustion engine, having an oil pump, a water pump, an oil cooler/oil filter unit, characterized in that the oil pump, the water pump and the oil cooler-/oil filter unit are provided as separate interchangable subassemblies and are combined and interconnected into a constructional unit that can be mounted on the internal combustion engine, and said oil cooler/oil filter unit including a housing provided with a mounting surface for attachment to the internal combustion engine, first and second mating flanges on the housing and on the water pump being fastened together, third and fourth mating flanges on the water pump and on the oil pump being fastened together, and oil and water connecting lines extending through the flanges.

2. The assembly according to claim 1, wherein the oil pump and water pump have housings containing a common drive shaft, and all channels for the supply and discharge of oil and water are mounted in the housings.

* * * * *